US008875628B2

(12) United States Patent
Depta et al.

(10) Patent No.: US 8,875,628 B2
(45) Date of Patent: Nov. 4, 2014

(54) DATA CARRIER AND METHOD FOR THE PRODUCTION THEREOF

(75) Inventors: Georg Depta, Rosenheim (DE); Peter Franz, Pienzenau-Bruck (DE)

(73) Assignee: Giesecke & Devrient GmbH, Munich (DE)

( * ) Notice: Subject to any disclaimer, the term of this patent is extended or adjusted under 35 U.S.C. 154(b) by 1178 days.

(21) Appl. No.: 11/915,965

(22) PCT Filed: May 22, 2006

(86) PCT No.: PCT/EP2006/004819

§ 371 (c)(1),
(2), (4) Date: Nov. 29, 2007

(87) PCT Pub. No.: WO2006/128607

PCT Pub. Date: Dec. 7, 2006

(65) Prior Publication Data

US 2008/0250954 A1 Oct. 16, 2008

(30) Foreign Application Priority Data

Jun. 1, 2005 (DE) ..... 10 2005 025 095

(51) Int. Cl.
*B41M 1/10* (2006.01)

(52) U.S. Cl.
CPC ..... *B41M 1/10* (2013.01)
USPC ..... 101/170; 101/150

(58) Field of Classification Search
USPC ..... 101/150, 170
See application file for complete search history.

(56) References Cited

U.S. PATENT DOCUMENTS

| | | | | |
|---|---|---|---|---|
| 4,523,777 | A | 6/1985 | Holbein et al. | |
| 4,732,410 | A | 3/1988 | Holbein et al. | |
| 4,765,656 | A * | 8/1988 | Becker et al. | 283/70 |
| 5,122,813 | A * | 6/1992 | Lass et al. | 347/225 |
| 5,298,922 | A * | 3/1994 | Merkle et al. | 347/232 |
| 5,304,789 | A | 4/1994 | Lob et al. | |
| 5,310,222 | A | 5/1994 | Chatwin et al. | |
| 5,672,020 | A * | 9/1997 | Leonard et al. | 400/690.4 |

(Continued)

FOREIGN PATENT DOCUMENTS

| | | | |
|---|---|---|---|
| CN | 1933977 | A | 3/2007 |
| CN | 1968824 | A | 5/2007 |

(Continued)

OTHER PUBLICATIONS

Examiner's First Report, Australian Patent Application No. 2006254436, Dec. 20, 2010, 7 pages.

(Continued)

*Primary Examiner* — David Banh
(74) *Attorney, Agent, or Firm* — Lathrop & Gage LLP

(57) ABSTRACT

The invention relates to a data carrier, especially a value document or security paper, having a substrate (20) and, applied on the substrate, a coating (12) into which, through the action of laser radiation, markings (14) are introduced in the form of patterns, letters, numbers or images. According to the present invention, it is provided that the coating (12) includes a laser-radiation-absorbing layer (22) and a printing layer (24) that is disposed over the absorbing layer and that is at least partially transmissive to the laser radiation, and that the printed substrate is pressed (26) during or after the imprinting of the at least partially transmissive layer (24).

20 Claims, 7 Drawing Sheets

(56) References Cited

U.S. PATENT DOCUMENTS

Figure 1:
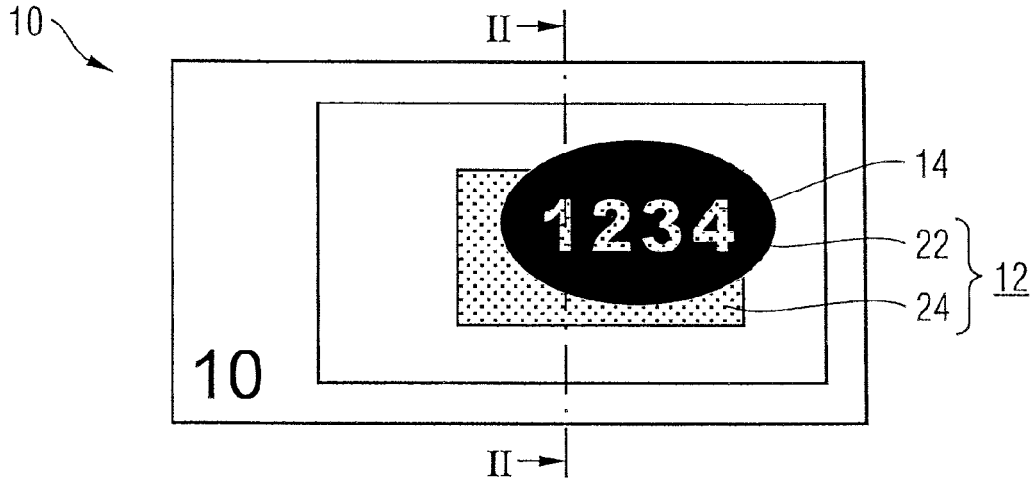

| | | | | |
|---|---|---|---|---|
| 5,817,205 | A * | 10/1998 | Kaule | 156/233 |
| 5,944,356 | A | 8/1999 | Bergmann et al. | |
| 6,082,778 | A | 7/2000 | Solmsdorf | |
| 6,098,546 | A * | 8/2000 | Schell | 101/492 |
| 6,135,503 | A * | 10/2000 | Lob et al. | 283/63.1 |
| 6,183,018 | B1 * | 2/2001 | Braun et al. | 283/114 |
| 6,255,948 | B1 | 7/2001 | Wolpert et al. | |
| 6,379,779 | B1 * | 4/2002 | Murl | 428/195.1 |
| 6,494,965 | B1 | 12/2002 | Walker et al. | |
| 6,633,321 | B1 * | 10/2003 | Maurer | 347/224 |
| 6,776,933 | B1 * | 8/2004 | Chatwin et al. | 264/1.34 |
| 7,049,267 | B2 * | 5/2006 | Wagner et al. | 503/200 |
| 7,090,935 | B2 * | 8/2006 | Azakami et al. | 428/834 |
| 7,434,727 | B2 * | 10/2008 | Bolognini | 235/380 |
| 2002/0018430 | A1 * | 2/2002 | Heckenkamp et al. | 369/109.01 |
| 2002/0056758 | A1 * | 5/2002 | Stenzel et al. | 235/493 |
| 2003/0096084 | A1 | 5/2003 | Hoppe et al. | |
| 2003/0136847 | A1 * | 7/2003 | Braun | 235/487 |
| 2003/0224151 | A1 * | 12/2003 | Mitchell et al. | 428/195.1 |
| 2004/0007145 | A1 | 1/2004 | Franz et al. | |
| 2004/0022967 | A1 | 2/2004 | Lutz et al. | |
| 2004/0025728 | A1 | 2/2004 | Adamczyk et al. | |
| 2004/0050269 | A1 * | 3/2004 | Adamczyk et al. | 101/150 |
| 2004/0232691 | A1 * | 11/2004 | Lazzerini | 283/67 |
| 2004/0234816 | A1 * | 11/2004 | Azakami et al. | 428/694 B |
| 2005/0095408 | A1 | 5/2005 | LaBrec et al. | |
| 2005/0142342 | A1 | 6/2005 | Lutz et al. | |
| 2006/0107854 | A1 * | 5/2006 | Bauer et al. | 101/170 |
| 2006/0124750 | A1 | 6/2006 | Reiner et al. | |
| 2006/0145468 | A1 * | 7/2006 | Plaschka et al. | 283/72 |
| 2006/0151989 | A1 * | 7/2006 | Muke et al. | 283/67 |
| 2006/0191427 | A1 * | 8/2006 | Geddes et al. | 101/33 |
| 2007/0165182 | A1 | 7/2007 | Hoffmuller | |
| 2007/0204755 | A1 | 9/2007 | Moreau | |
| 2007/0211238 | A1 | 9/2007 | Hoffmuller | |
| 2007/0216518 | A1 * | 9/2007 | Hoffmuller | 340/5.85 |
| 2007/0229928 | A1 | 10/2007 | Hoffmuller | |
| 2007/0241553 | A1 | 10/2007 | Heim | |
| 2007/0246932 | A1 * | 10/2007 | Heine et al. | 283/94 |
| 2007/0246933 | A1 | 10/2007 | Heim | |
| 2007/0274559 | A1 | 11/2007 | Depta | |
| 2008/0014378 | A1 | 1/2008 | Hoffmuller | |
| 2008/0054621 | A1 | 3/2008 | Burchard | |
| 2008/0079257 | A1 | 4/2008 | Fessl | |
| 2008/0088859 | A1 | 4/2008 | Depta | |
| 2008/0160226 | A1 | 7/2008 | Kaule | |
| 2008/0163994 | A1 | 7/2008 | Hoppe | |
| 2008/0191462 | A1 | 8/2008 | Depta et al. | |
| 2008/0198468 | A1 | 8/2008 | Kaule | |
| 2008/0216976 | A1 | 9/2008 | Ruck | |
| 2008/0250954 | A1 | 10/2008 | Depta | |
| 2008/0258456 | A1 | 10/2008 | Rahm | |
| 2008/0290647 | A1 * | 11/2008 | Adamczyk et al. | 283/72 |
| 2010/0290039 | A1 | 11/2010 | Endres et al. | |

FOREIGN PATENT DOCUMENTS

| | | | | |
|---|---|---|---|---|
| DE | 03048733 | | 7/1982 | |
| DE | 19704003 | | 8/1998 | |
| DE | 10013410 | | 9/2001 | |
| DE | 10106415 | | 8/2002 | |
| DE | 10247591 | | 4/2004 | |
| EP | 0372274 | | 6/1990 | |
| EP | 481388 | | 4/1992 | |
| EP | 1516749 | | 3/2005 | |
| EP | 1580015 | A1 | 9/2005 | |
| EP | 1687763 | | 8/2006 | |
| GB | 2111910 | | 7/1983 | |
| JP | 2002-370457 | | 12/2002 | |
| WO | WO02/20268 | | 3/2002 | |
| WO | WO0220279 | | 3/2002 | |
| WO | WO 02/41245 | | 5/2002 | |
| WO | WO02103624 | | 12/2002 | |
| WO | WO 03/023723 | A1 | 3/2003 | |
| WO | WO 03/079283 | | 9/2003 | |
| WO | WO03079283 | | 9/2003 | |
| WO | WO 03/095745 | A1 | 11/2003 | |
| WO | WO 2004/009371 | | 1/2004 | |
| WO | WO2004022355 | | 3/2004 | |
| WO | WO 2004037548 | A1 * | 5/2004 | B42D 15/00 |
| WO | WO2004109590 | | 12/2004 | |
| WO | WO2005048182 | | 5/2005 | |
| WO | WO 2005/102728 | | 11/2005 | |
| WO | WO 2005/108109 | A1 | 11/2005 | |
| WO | WO 2005105473 | | 11/2005 | |
| WO | WO 2005105474 | | 11/2005 | |
| WO | WO 2005105475 | | 11/2005 | |
| WO | WO 2005108106 | | 11/2005 | |
| WO | WO 2005108108 | | 11/2005 | |
| WO | WO 2005108110 | | 11/2005 | |
| WO | WO 2005/123415 | | 12/2005 | |
| WO | WO 2005/123415 | A1 | 12/2005 | |
| WO | WO 2006005434 | | 1/2006 | |
| WO | WO 2006015733 | | 2/2006 | |
| WO | WO2006015733 | | 2/2006 | |
| WO | WO 2006018171 | | 2/2006 | |
| WO | WO 2006018172 | | 2/2006 | |
| WO | WO 2006040069 | | 4/2006 | |
| WO | WO 2006056342 | | 6/2006 | |
| WO | WO 2006072380 | | 7/2006 | |
| WO | WO 2006087138 | | 8/2006 | |
| WO | WO 2006099971 | | 9/2006 | |
| WO | WO 2006119896 | | 11/2006 | |
| WO | WO 2006128607 | | 12/2006 | |
| WO | WO 2007006445 | | 1/2007 | |
| WO | WO 2007006455 | | 1/2007 | |
| WO | WO 2007076952 | | 7/2007 | |
| WO | WO 2007079851 | | 7/2007 | |
| WO | WO 2007115648 | | 10/2007 | |

OTHER PUBLICATIONS

Rudolf L. van Renesse, Optical Document Security, 3rd edition, 2005, pp. 84-87.

Australian Statement of Grounds and Particulars, Australian Patent Application 2006254436, Nov. 9, 2012, 6 pages.

Japanese Notification of Reason for Refusal, Japanese Application No. 2008-513972, Oct. 26, 2011, with English translation, 11 pages.

Japanese Final Rejection, Japanese Application No. 2008-513972, Oct. 26, 2011, with English translation, Jan. 31, 2013, 8 pages.

J. van den Berg et al., "New optical security features in plastic documents," In *Optical Security and Counterfeit Deterrence Techniques III*, van Renesse & Viegenthart, editors, Proceedings of SPIE vol. 3973, pp. 167-175, 2000.

R. van Renesse, "Noniridescent Optically Variable Devices," Chapter 9 in: *Optical Document Security*, 2nd edition, 1998, pp. 201-246.

International Search Report, International Application No. PCT/EP2006/004819, 8 pages, Jun. 28, 2007.

International Preliminary Report on Patentability, International Application No. PCT/EP2006/004819, 16 pages, Jun. 28, 2007.

323/kolnp/2005, Oct. 16, 2009, Adamczyck et al. Giesecke & Devrient GmbH.

231/kolnp/2003, Jan. 27, 2006, Adamczyck et al. Giesecke & Devrient GmbH.

2116/cal/1998, Feb. 24, 2006, Wolpert et al. Technical Graphiics Security Products, LLC.

1599/kolnp/2003, Sep. 2, 2005, Gartner et al. Crane & Co Inc et al.

2166/KOLNP/2005, Aug. 28, 2009, Reiner et al. Giesecke & Devrient GmbH.

113/kolnp/2007, Aug. 31, 2007, Depta et al. Giesecke & Devrient GmbH.

2503/kolnp/2004, Oct. 9, 2009, Giori et al. KBA Giori SA.

194/KOLNP/2003, Mar. 11, 2005, Franz et al. Giesecke & Devrient GmbH.

* cited by examiner

DATA CARRIER AND METHOD FOR THE PRODUCTION THEREOF

CROSS-REFERENCE TO RELATED APPLICATIONS

This application is the U.S. National Stage of International Application No. PCT/EP2006/004819, filed May 22, 2006, which claims the benefit of German Patent Application DE 10 2005 025 095.5, filed Jun. 1, 2005, all of which are hereby incorporated by reference to the extent not inconsistent with the disclosure herewith.

The present invention relates to a data carrier, especially a value document or a security paper, having a substrate and, applied on the substrate, a coating into which, through the action of laser radiation, markings are introduced in the form of patterns, letters, numbers or images. The present invention also relates to a method and an apparatus for manufacturing such a data carrier.

Value documents, such as banknotes, stocks, bonds, certificates, vouchers, checks, admission tickets and the like, are normally provided with an individualizing mark, such as a serial number. To increase security, this mark is often applied to the value document multiple times. For example, banknotes are doubly numbered so that each half of the banknote is uniquely identifiable. Here, the two numerals are normally identical.

Identification cards have long been provided with an individual marking by means of laser engraving. In marking by laser engraving, through suitable guidance of a laser beam, the optical properties of the card material are irreversibly changed in the form of a desired marking. For example, in publication DE 30 48 733 A1 is described an identification card having applied information and exhibiting, on one surface, different colored layer regions that are stacked and that are at least partially interrupted by visually perceptible personalization data.

Central banks and banknote designers are calling for more space to be created on banknotes for security features. Here, just like the individualization through laser inscription, the numbering competes with other security features for the available space on the banknote. The problem arises with greater frequency in the enhancement of existing banknote series in which the design is to remain substantially unchanged.

A conventional numbering requires a white or at least light background, which, in addition, must not be executed in intaglio printing, since otherwise ink residues can get in the numbering units and impair their function. Thus, due to the usual register variations, a relatively large space must be held out for the numbering.

Also in the case of a laser numbering, a certain space in the design must be provided specially for the numbering if other printing components or security elements are not to be disrupted since, in laser marking stacked layer sequences, also overlying non-absorbing overprints are normally removed together with the absorbing ink layers.

Based on that, the object of the present invention is to propose a data carrier of the kind mentioned above that can easily be provided with an individual marking having high counterfeit security. In particular, the marking should require little space on the data carrier and permit easy integration in existing designs or print images.

This object is solved by the data carrier and the manufacturing method having the features of the independent claims. Developments of the present invention are the subject of the dependent claims.

According to the present invention, in a method for manufacturing a data carrier having a visually perceptible marking in the form of patterns, letters, numbers or images, a) a predefined laser radiation spectrum is chosen,
b) a laser-radiation-absorbing layer is applied to the substrate of the data carrier,
c) a layer that is at least partially transmissive to the laser radiation is imprinted over the absorbing layer,
d) the substrate is pressed during or after the application of the at least partially transmissive layer, and
e) the applied coating is impinged on with laser radiation of the chosen laser radiation spectrum to produce the visually perceptible markings at least in the absorbing layer.

Without being bound to a specific explanation, according to the current understanding, due to the high pressure when pressing the substrate, a particularly good bond of the at least partially transmissive printing ink with the substrate is created such that, in the subsequent marking step e), the absorbing layer can be removed without destroying the partially transmissive printing layer.

The individual marking can thus be introduced, as is common and expedient, only at the end of the different printing passes required for the manufacture of the data carrier. At the same time, due to the partially transmissive layer still disposed over the marking, the appearance for the viewer seems as if the marking were already introduced in a work step at the beginning of the production chain. This facilitates designs having an optically appealing overall impression and leads to high counterfeit security, since such an individual marking does not permit reproduction through a subsequently applied printing layer.

In a preferred method variant, in step c), the at least partially transmissive layer is applied by means of intaglio printing and, in doing so, the substrate is pressed. According to another, likewise advantageous variant, after the application of the absorbing and the at least partially transmissive layer, the substrate is blind embossed. A further preferred possibility for pressing the printed substrate consists in subjecting the substrate to a calendering step after the application of the absorbing and the at least partially transmissive layer.

In all method variants, in step c), the at least partially transmissive layer is advantageously imprinted in the form of fine patterns, especially in the form of guilloches, microtext, graphic elements or the like.

In step b), the absorbing layer is preferably imprinted and is particularly preferably imprinted by means of screen printing, for example with a metallic effect ink, such as a silver or gold ink. Alternatively, in step b), also a coated or uncoated foil can be applied as the absorbing layer. For example, as the coated foil, a colored foil that is non-absorbing even at the chosen laser wavelength and that is provided with a thin metal layer, such as a vapor-deposited aluminum layer, can be used. In all variants, in step b), it is particularly useful to form the absorbing layer as a contiguous area.

According to an advantageous development of the present invention, the absorbing layer in step b) can also be applied in sub-regions with different printing methods or printing parameters such that the sub-regions are affected differently by the laser radiation upon the laser impingement in step e). For example, a first sub-region of the absorbing layer can be imprinted in intaglio printing and a second sub-region in a nyloprint method. In the marking in step e), the second sub-region is then removed together with the underlying absorbing layer, while the first sub-region is maintained due to pressing.

As mentioned, the laser parameters in step e) can be chosen such that the at least partially transmissive layer is completely maintained upon laser impingement. However, it is also possible to change the laser parameters during the impingement in step e) to partially maintain and partially remove the partially transmissive layer.

Furthermore, embossings, especially embossings obtained without ink control, can be obtained through a suitable choice of the laser parameters in the impingement in step e), thus further increasing the security of the aggregate element. Alternatively, the laser parameters during the impingement in step e) can also be changed to partially maintain and partially remove the embossings in the coating.

The impingement with laser radiation in step e) advantageously occurs from the substrate front, so from the substrate side on which the absorbing layer and the partially transmissive layer are applied. However, it is also possible to conduct the laser impingement from the substrate back. In this case, it is advantageous if the substrate exhibits as low an absorption as possible at the laser wavelength.

The absorbing layer and the at least partially transmissive layer can be applied completely or partially overlapping each other. Furthermore, a protective layer can be applied before and/or after the impingement with laser radiation.

The choice of the laser radiation spectrum in step a) typically occurs through the choice of a suitable laser wavelength. As the laser source for the marking in step e), advantageously, an infrared laser in the wavelength range from 0.8 μm to 3 μm, especially a Nd:YAG laser, is used. Expediently, for impingement, the laser beam is guided across the substrate with a speed of more than 1 m/s, preferably of more than 4 m/s, particularly preferably of more than 10 m/s, to accommodate the high processing speeds in security printing.

The present invention also includes a data carrier of the kind mentioned above, whose coating includes a laser-radiation-absorbing layer and a printing layer that is disposed over the absorbing layer and that is at least partially transmissive to the laser radiation, and in which the printed substrate is pressed during or after the imprinting of the at least partially transmissive layer.

In a preferred embodiment, the at least partially transmissive layer is formed by an intaglio printing layer. In another, likewise preferred embodiment, the at least partially transmissive layer includes an ink mixture that exhibits a laser-radiation-absorbing mixture component and a laser-radiation-transparent mixture component.

As described in detail below, under the action of the laser radiation, the absorbing mixture component can, for example, be bleached, vaporized, changed in its reflection properties or transformed by a chemical reaction into a material having other optical properties. However, under the action of the laser radiation, it is also possible that the absorbing mixture component undergoes no changes that are perceptible for the naked eye. The ink mixture preferably contains optically variable color pigments, especially optically variable liquid crystal pigments or a transparent intaglio ink being able to be used as the laser-radiation-transparent mixture component and, for example, optically variable interference layer pigments as the absorbing mixture component. Also other ink components that are irreversibly changeable in their optical properties, such as an intaglio ink, a metallic effect ink or metallic pigments, a luminescent ink or luminescent pigments, glossy pigments or a thermochromic ink, may be used as the absorbing mixture component.

It is also possible, in the marking in step e), that the optical properties of the absorbing mixture component do not change, but rather that the ink mixture includes an ink component that coacts with the absorbing mixture component and whose optical properties are indirectly irreversibly changed, namely through the absorption of the laser radiation in the absorbing mixture component, particularly the local temperature rise caused thereby in the coating.

Particularly ink components that themselves are non-absorbing, such as certain intaglio inks, luminescent inks or luminescent pigments, glossy pigments or thermochromic inks may be used as such a coacting ink component. As the absorbing mixture component, the ink mixture contains, for example, soot, graphite, $TiO_2$ or an infrared absorber.

The at least partially transmissive layer is preferably imprinted in the form of fine patterns, especially in the form of guilloches, microtext, graphic elements or the like.

The absorbing layer, in contrast, is expediently formed as a contiguous area. It can especially be formed by a printing layer, for example a screen printing layer, or by a coated or uncoated foil. In a further variant of the present invention, the absorbing layer includes an ink mixture that exhibits, in the manner described above, a laser-radiation-absorbing mixture component and a laser-radiation-transparent mixture component.

According to an advantageous embodiment, the coating exhibits optically variable properties. It can also include one or more protective layers that can be applied before or after the laser impingement. In all embodiments, the absorbing layer and the at least partially transmissive layer can completely or partially overlap each other.

Below the absorbing layer, the coating can include a further layer that is at least partially transmissive to the laser radiation and that is exposed by the marking in method step e). In the region of the markings, the further layer can include, for example, visually perceptible features, features that are activatable through certain viewing conditions, such as UV illumination, and/or machine-readable features.

A paper substrate, such as a cotton paper, or a plastic substrate, such as a PET or PP foil, can be used as the substrate of the data carrier. Advantageously, the data carrier constitutes a security element, a banknote, a value document, a passport, an identification card, a certificate or another product protection means.

The present invention also includes a printing machine having a laser system for carrying out the method described above. Here, the laser system is disposed over an impression cylinder of the printing machine to impinge on the data carrier to be marked, on the impression cylinder, with laser radiation. Preferably, the laser system is designed for the vibrations occurring in the printing machine in the printing process. This can occur, for example, in that the laser system is formed having a supporting frame that, in accordance with a finite-elements-method analysis of the vibrations occurring, is designed such that the laser system co-executes the vibrations of the printing machine without being rocked.

The laser system advantageously includes at least one marking laser having a horizontally disposed laser resonator that is connected via a beam pipe with a scan head to deflect the laser beam. In expedient embodiments, the laser system includes more than one marking laser, for example 2, 4 or 6 marking lasers.

The laser system is preferably vertically movable between one or more working positions, for laser impingement on the data carrier, and a service position, the impression cylinder and downstream inking units of the printing machine being accessible in the service position.

Further, the laser system advantageously exhibits, disposed immediately above the impression cylinder, a shielded chamber that shields laser radiation and is designed for the exhaust of the gases and dusts created when marking.

Further exemplary embodiments and advantages of the present invention are explained below by reference to the drawings, in which a depiction to scale and proportion was omitted in order to improve their clarity.

Figure 2:
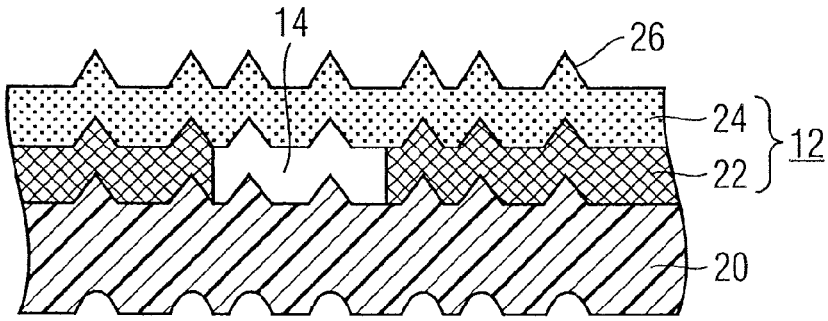
Figure 3:
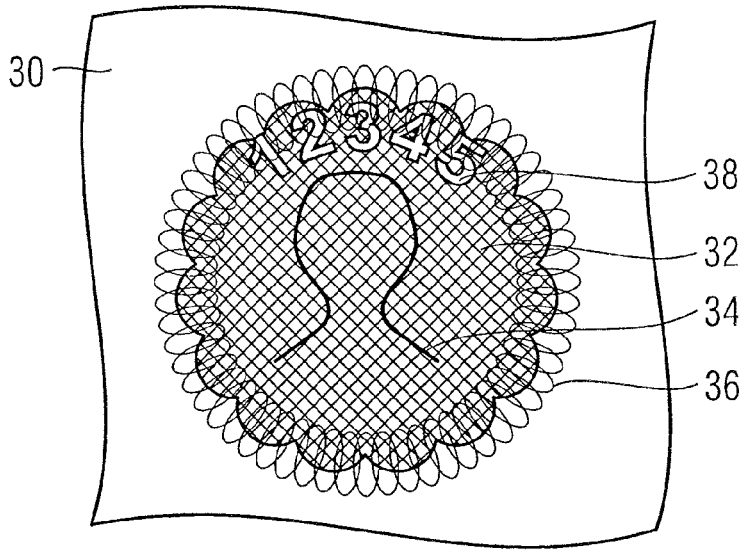
Figure 4:
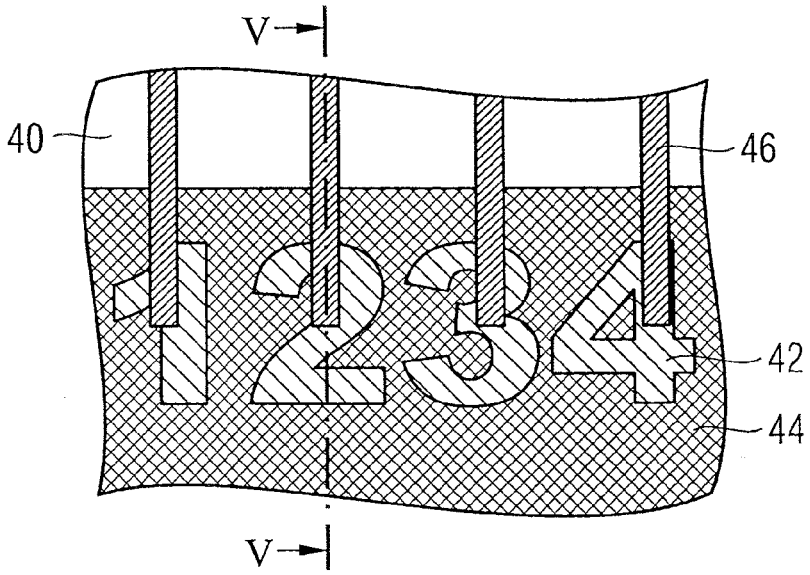
Figure 5:
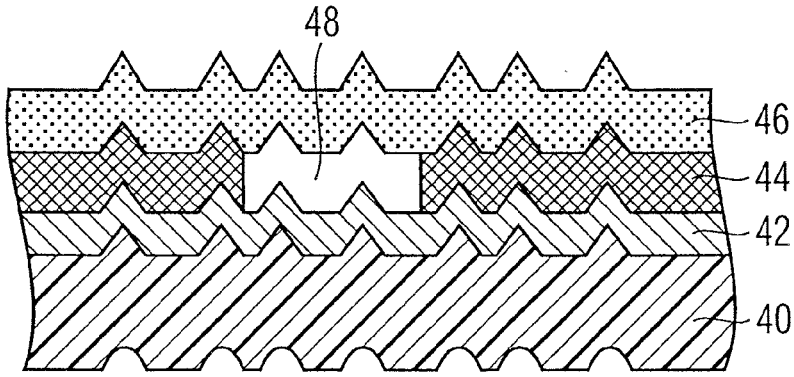
Figure 6:
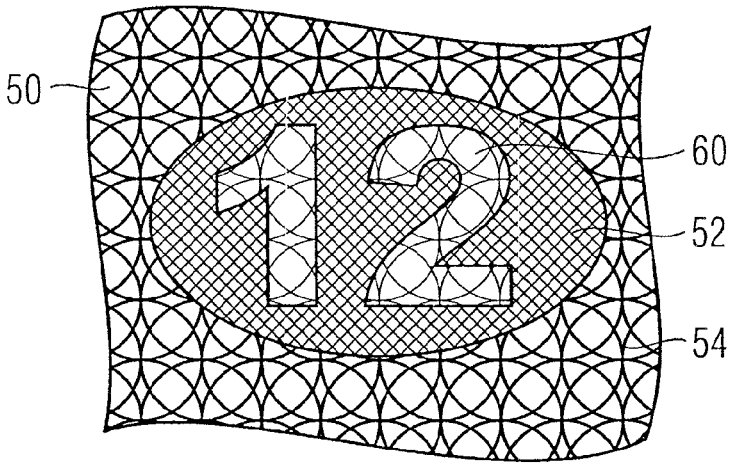
Figure 7:
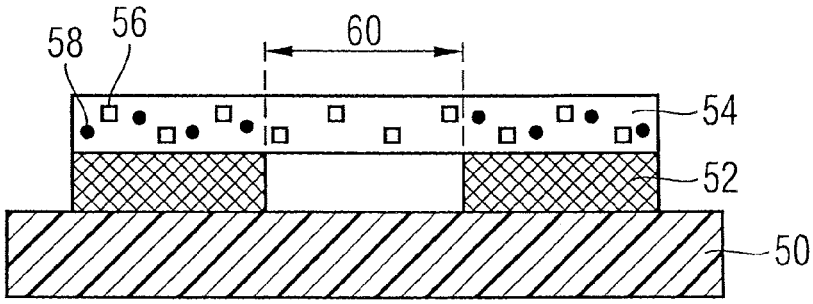
Figure 8:
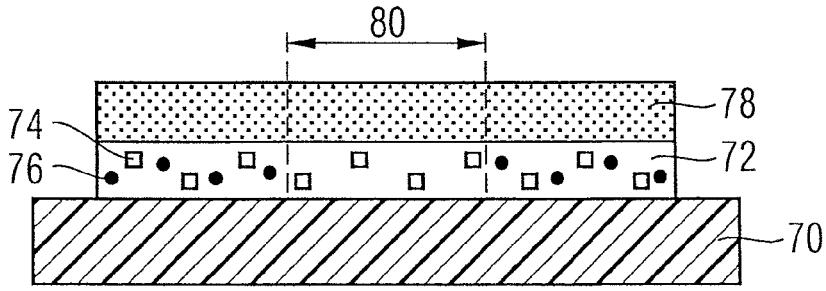
Figure 9:
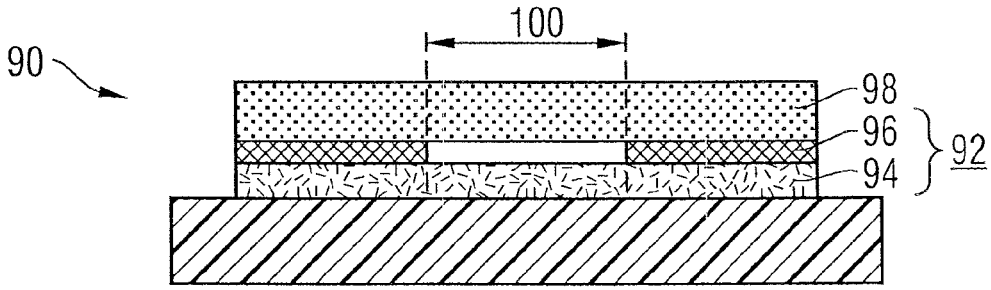
Figure 10:
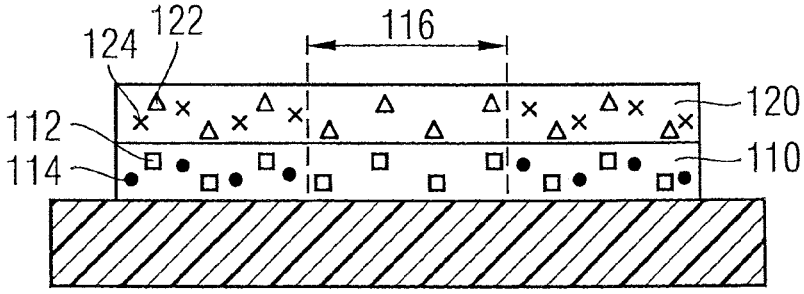
Figure 11:
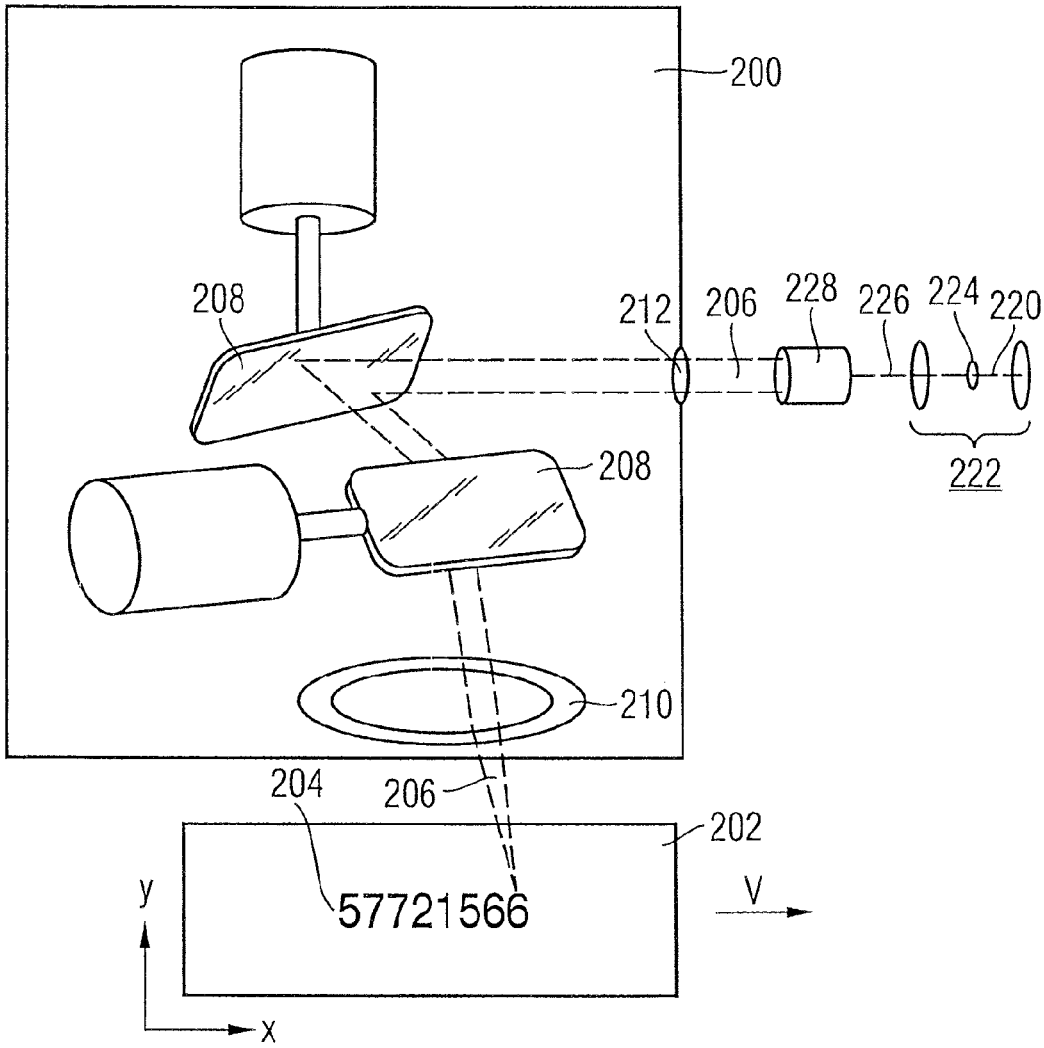
Figure 12:
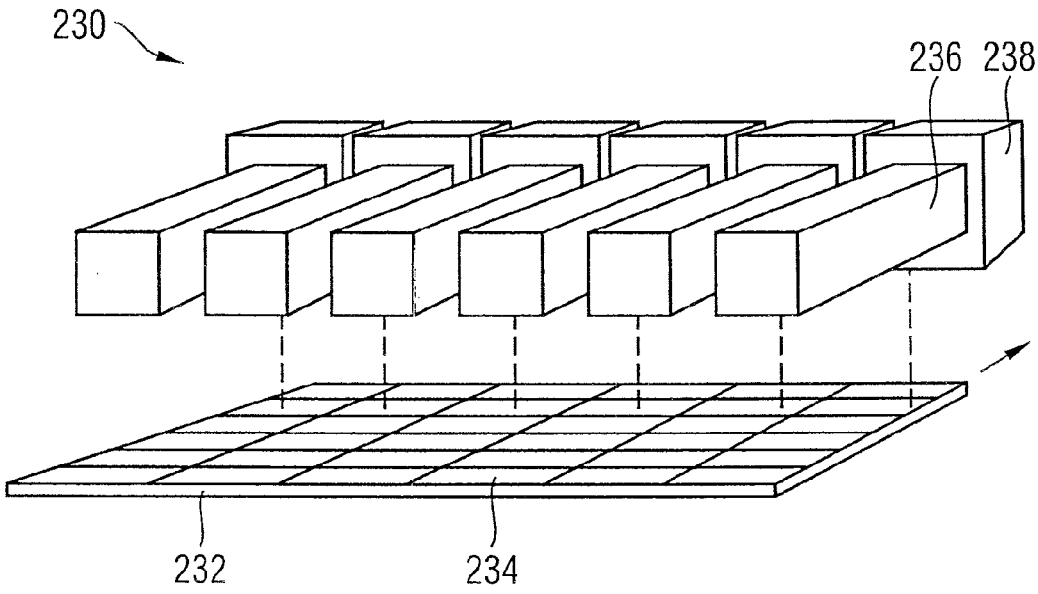
Figure 13:
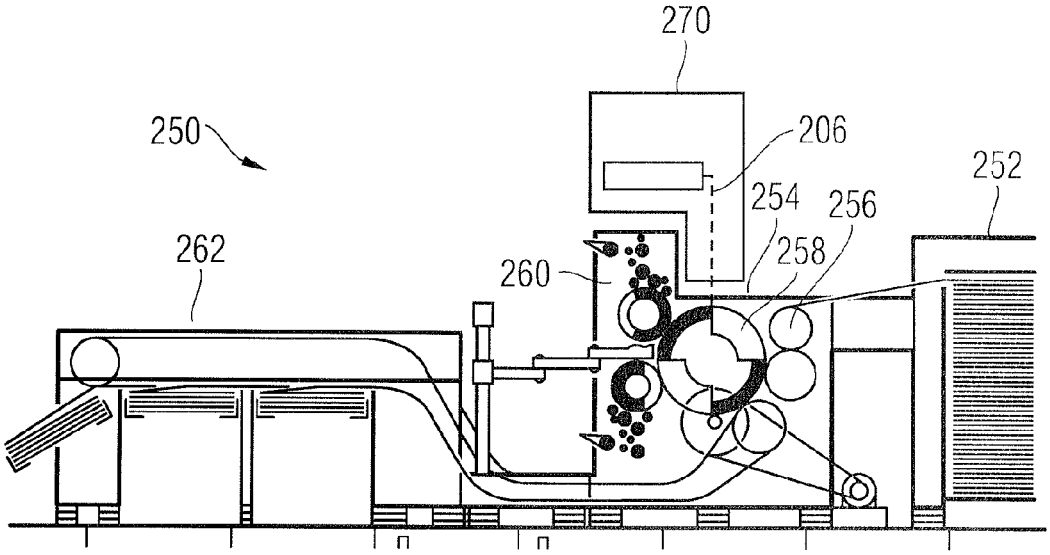
Figure 14:
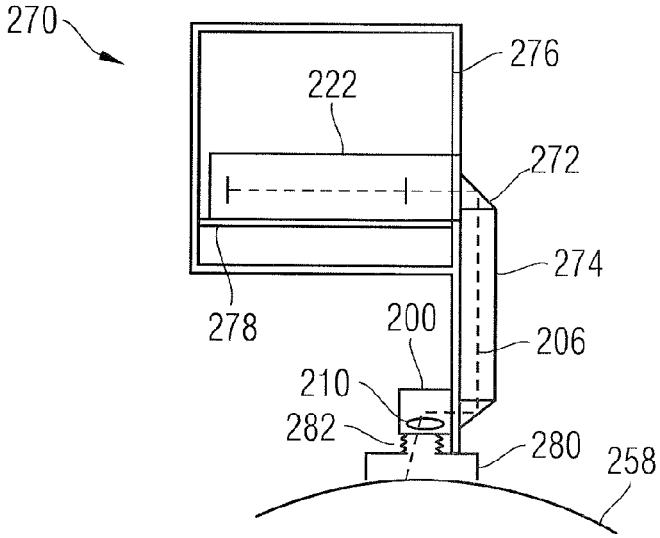

Shown are:

FIG. 1 a schematic diagram of a marked banknote according to an exemplary embodiment of the present invention, FIG. 2 a cross section through the banknote in FIG. 1 along the line II-II in the region of the marking, FIG. 3 a top view of the marking of a banknote according to another exemplary embodiment of the present invention, FIG. 4 a top view of the marking of a banknote according to a further exemplary embodiment of the present invention, FIG. 5 a cross section through the banknote in FIG. 4 along the line V-V in the region of the marking, FIGS. 6 and 7 a top view of or a cross section through a value document according to a further exemplary embodiment of the present invention, FIG. 8 to 10 cross sections of banknotes according to further exemplary embodiments of the present invention, FIG. 11 a schematic diagram of a vector laser coder for the inventive marking of data carriers, FIG. 12 a schematic diagram of vector laser coders for inscribing a security sheet, FIG. 13 a schematic view of a printing machine that is provided with a laser system according to the present invention for marking banknotes and the like, and FIG. 14 the laser system in FIG. 13, in cross section. The basic principle of the present invention will now be explained first with reference to FIGS. 1 and 2 using a banknote as an example. FIG. 1 shows a schematic diagram of a banknote 10 on whose front a coating 12 is applied in which, by the action of an infrared laser beam, a marking 14 is introduced, in the exemplary embodiment in the form of the numeric string "1234". FIG. 2 shows a cross section through the banknote 10 along the line II-II in FIG. 1 in the region of the marking 14.

As is perceptible in viewing FIGS. 1 and 2 together, the coating 12 applied to the paper substrate 20 of the banknote 10 includes two sub-layers: a first layer 22 that absorbs the laser radiation of the infrared laser used for marking, and a second layer 24 that is transparent to the laser radiation used.

Upon laser impingement, the laser radiation incident from the front of the substrate penetrates the transparent second layer 24 and produces the marking 14 in the absorbing first layer 22. Here, depending on the material used, the absorbing layer 22 can, for example, be locally bleached, vaporized, changed in its reflection or absorption properties, or transformed by a chemical reaction into a material having different optical properties.

Here, the second, transparent layer 24 is maintained also in the region of the marking 14. According to the present invention, this is achieved in that the substrate 20 is pressed during or after the imprinting of the second layer 24. Due to the pressure occurring here, according to the current understanding, a particularly stable bond of the printing layer 24 and the substrate 20 is produced that permits the introduction of a marking into the absorbing layer 22 without destroying the transparent layer 24.

In the exemplary embodiment in FIGS. 1 and 2, the pressing of the substrate is achieved in that the transparent layer 24 is imprinted with an intaglio printing method with a high pressure of, for example, 50,000 kPa. Compared with other common printing techniques, the intaglio printing technique permits a relatively thick ink coating. Together with the partial deformation 26 of the paper surface, the thick ink layer 24 that is created by pressing the paper into the recess of the printing plate is easily manually tangible, also for the layperson, and thus, based on its tactility, easy to perceive as an authenticity feature.

A more complex exemplary embodiment is depicted in FIG. 3, which shows a top view of a banknote 30 designed according to the present invention. For marking the banknote 30, a Nd:YAG laser, for example, having a wavelength of 1.064 μm is used, as described in detail below.

At the manufacture of the banknote 30, a silver-colored effect ink layer 32 in the form of a coin is first applied contiguously to the banknote substrate in the screen printing method. Here, the effect ink layer 32 forms the absorbing layer for the chosen infrared laser radiation. Subsequently, a portrait 34, depicted only schematically in FIG. 3, is blind embossed in the effect ink layer with an intaglio printing plate, and a guilloche-shaped edge pattern 36 is imprinted in intaglio printing.

Then the marking region is lasered from the printed side of the banknote 30 and, in doing so, a desired marking 38, for example in the form of a serial number or another individualizing mark, is produced in the effect layer 32. In the exemplary embodiment, the marking 38 is depicted schematically as the numeric string "12345". Due to its high absorption, the silver effect ink 32 is completely removed in the lasered region 38 such that the marking stands out in high contrast in reflected light and particularly in transmitted light.

Further, in the regions 38, the intaglio printing ink of the edge pattern 36, which lies over the effect layer 32 and is transparent to the laser radiation and which was not destroyed upon laser impingement due to the good bond of the printing ink and the paper, created by the high pressure, is still perceptible. In this way is created in the print image an individual marking 38 that, although it was introduced only at the end of the different printing passes of the banknote, appears for the viewer as if it was already executed in an earlier work step. This leads to a significant increase in the counterfeit security, since the effort for reproductions is considerable, and the marking 38 cannot be imprinted subsequently with white or light ink due to the printing layer 36 partially covering it.

A further exemplary embodiment of the present invention is depicted in FIGS. 4 and 5, FIG. 4 showing a top view of a section of a banknote according to the present invention, and FIG. 5 showing a section along the line V-V in FIG. 4 in the region of the marking.

In this exemplary embodiment, first, a colored, line-shaped imprint 42 that is transparent to the laser radiation used for marking is applied to the paper substrate 40 of the banknote. This imprint can be imprinted, for example, in a nyloprint method. The imprint 42 is overprinted with an effect ink layer 44 that absorbs the chosen laser wavelength. Then the printed substrate is printed on with an intaglio printing ink 46 that is transparent to the laser radiation and, in doing so, is pressed at the same time.

In the subsequent marking step, the sequence of layers is impinged on from the printed side with laser radiation of a previously chosen wavelength, for example 1.064 μm, to introduce the desired marking 48, represented in the exemplary embodiment by the numeric string "1234". The absorbing effect ink layer 44 is removed locally by the action of the laser radiation such that the underlying imprint 42 that, due to its transparency, is not influenced by the laser radiation, becomes visible. The intaglio printing ink 46 is likewise transparent to the laser radiation and, due to the good adhesion to the paper, achieved by the pressing, is also maintained in the lasered regions 48, such that an image impression as shown in FIG. 4 results.

In other variants, the imprint 42 can, for example, also be executed in iridescent printing, whose color transition is exposed in the marking regions. The imprint can also include features that are invisible to the naked eye and that are activated and/or made visible only by certain illumination conditions, such as UV irradiation. Also other, especially machine-readable features can be provided.

In a similar way, also the absorbing layer 22 or 44 in the exemplary embodiments in FIGS. 2 and 5 can be executed in iridescent printing, two inks that differ in their absorption behavior at the chosen laser wavelength expediently being used for the iridescent printing. In the marking step, it is then possible to produce different appearances for the two inks. In the visible spectral range, the two inks used can appear to have the same hue and differ only in their infrared absorption at laser wavelength.

According to a further exemplary embodiment, in steel engraving, a colored edge that is invisible to the human eye, but leads to a different absorption at the IR laser wavelength, can be used for the at least partially transmissive layer 24 or 46. In this way, the partially transmissive layer can be removed in sub-regions having high IR absorption, while it is maintained in sub-regions having low IR absorption.

FIGS. 6 and 7 show a further exemplary embodiment of the present invention, in which is imprinted, instead of a transparent layer, an only partially transmissive layer that also partially absorbs the laser radiation. Here, FIG. 6 shows a top view, and FIG. 7 a cross section through a value document according to the present invention. For the sake of simplicity, the embossing of the layers by the intaglio printing, indicated in FIGS. 2 and 5, is no longer depicted in the subsequent figures, even when intaglio printing methods are used.

On a substrate 50, for example a banknote or another value document, is first applied a laser-radiation-absorbing layer 52, for example a contiguous silver-colored screen printing layer. On this absorbing layer 52 is imprinted, in the form of a fine line pattern, a marking layer 54 that is partially transmissive to the laser radiation. Depending on the color design of the layer 52 and of the fine line pattern 54, the latter is more or less clearly perceptible with the naked eye in the overlap region. The marking layer 54 consists of an ink mixture composed of two mixture components 56 and 58, one of the mixture components 56 being transparent to the radiation of the infrared laser subsequently used for marking, while the other mixture component 58 absorbs the laser radiation. In the exemplary embodiment, the ink mixture consists of a light primary color 56 that is transparent to the laser radiation and to which absorbing soot particles 58 are added.

In the region 60, the marking layer 54 was irradiated with the marking laser with suitably chosen laser parameters, causing the absorbing mixture component 58 to be removed, changed or deactivated through the action of the laser radiation. Here, depending on the material used, the absorbing mixture component 58 is, for example, bleached, vaporized, changed in its reflection properties or transformed by a chemical reaction into a material having other optical properties such that, due to the irradiation, the optical properties of the ink mixture are irreversibly changed in the region 60. Here, possible effects that can be used include a color change, the production of a color alteration, the lightening of a color, the change of the tilt color of an effect ink mixture, or the local change of the polarization properties or the luminescence properties of the marking layer 54. In the exemplary embodiment, upon impingement with laser radiation, the soot particles 58 are removed from the ink mixture such that, in the irradiated region 60, merely the light ink 56 is left over, as is perceptible in the top view in FIG. 6.

In addition to the change in the marking layer 54 itself, the laser radiation penetrates through the partially transmissive layer 54 in the region 60 and likewise produces a visually perceptible change in the absorbing layer 52, as already described above. The marking 60 that is depicted in the exemplary embodiment as the numeric string "12" is thus inscribed in the two layers 52 and 54 in perfect register. Since the line pattern formed by the marking layer 54 was imprinted in a single work step, the light pattern portions and dark pattern portions within or outside of the marking 60 are in perfect register with each other. In this way, a register situation is created that cannot be reproduced with conventional methods.

In the further exemplary embodiment of the present invention depicted in cross section in FIG. 8 is imprinted on a substrate 70 an absorbing marking layer 72 that is formed from an ink mixture composed of two mixture components 74 and 76 of the kind just described. Over this marking layer is printed a laser-radiation-transparent layer 78 that can be imprinted, for example, in an intaglio printing method, as described above. Alternatively, to press the printed substrate, the substrate can also be subjected to a calendering step after the application of a non-embossing printing layer 78.

Upon the subsequent laser impingement of the printed substrate in the region 80, the absorbing mixture component 76 is removed from the marking layer 72, changed or deactivated, and the marking thus introduced into the coating. Here, the transparent layer 78 is maintained due to the good adhesion between the ink and the paper, also in the lasered region 80.

FIG. 9 shows a banknote 90 according to a further exemplary embodiment of the present invention. In this exemplary embodiment, the absorbing layer 92 is formed by a colored foil 94 that is vapor coated with a thin aluminum layer 96. Again, a laser-radiation-transparent layer 98 is imprinted on the coated foil, the printed substrate being pressed in or after this printing process. For marking, the banknote is impinged on in the desired regions 100 with infrared laser radiation, the aluminum layer 96 being vaporized locally or transformed into a transparent modification. Here, too, the transparent layer 98 is maintained.

The exemplary embodiment in FIG. 10 shows an embodiment in which both the absorbing layer 110 and the partially transmissive layer 120 are formed by an ink mixture composed of two mixture components of the kind described above, and each includes a laser-radiation-transparent mixture component 112 or 122 and an absorbing mixture component 114 or 124. After the application of the two layers 110, 120, the printed substrate is calendered and, in this way, pressed.

After the laser irradiation, the absorbing mixture components 114 and 124 of the two layers are removed, changed or deactivated in the marking region 116 that is impinged on such that this region displays a mixed color that stands out in high contrast from the surrounding color.

FIG. 11 schematically shows the scan head 200 of a vector laser coder with which a substrate 202 to be marked is provided with a serial number 204 or another individualizing marking. The substrate 202 can be a value document that has already been fully cut, a sheet having multiple ups of a value document, or a continuous-form security paper.

An infrared laser beam 220 is produced in the laser resonator 222 between the rear-view mirror and the output mirror and, with a mode diaphragm 224, restricted to a certain beam diameter and certain spatially distributed vibrational states, the so-called modes. The output beam 226 runs through a beam-expanding telescope 228, passes the entrance aperture 212 of the scan head 200 as an expanded beam 206 and is deflected via two movable mirrors 208, one of the mirrors producing the deflection in the x direction, the other mirror the deflection in the y direction. A flat-field lens 210 focuses the laser beam 206 on the substrate 202, where it produces a marking in the impinged-on coating in the manner described above.

The beam-expanding telescope 228 is used to ensure good focusability of the beam. The larger the expansion, the better the focusability by the flat-field lens 210 at the end of the beam path is. However, for larger expansion, also larger scanner mirrors 208 must be used that exhibit a greater inertia and thus result in a slower beam deflection. The beam expansion is preferably set such that the beam waist, in which the light beams run parallel, lies in the plane of the flat-field lens 210, which results in good focusability of the beam.

Another setting option consists in setting the beam waist to the entrance aperture 212 of the scan head 200 to avoid losses at the edge of the beam pattern; this results in a higher beam intensity on the substrate 202.

The flat-field lenses used typically exhibit focal lengths between 100 and 420 mm, a focal length of about 160 mm currently being preferred. The substrate 202 moves during the marking process at a certain speed v. This speed is detected by sensors and transmitted to a computer to control the movement of the mirrors 208 such that the substrate speed v is compensated when marking. This marking method can thus be employed particularly advantageously for the contactless marking of value documents that are processed at high speeds, as is usual in printing shops.

The inscription field on the substrate 202 typically exhibits the size of a banknote. For example, at a focal length of the flat-field lens 210 of 163 mm, the inscription field can be formed by an ellipse having axis lengths of about 190 mm and about 140 mm.

Depending on the substrate used, $CO_2$ lasers, Nd:YAG lasers or other laser types in the wavelength range from UV to far infrared may be used as the radiation sources, the lasers also often advantageously working with frequency doubling or tripling. Preferably, however, laser sources in the near infrared and especially Nd:YAG lasers having a fundamental wavelength of 1064 nm are used, since this wavelength range matches well with the absorption properties of the substrates and printing inks used. Depending on the application, the spot size of the laser radiation can be varied from a few micrometers to a few millimeters, for example by changing the distance of the flat-field lens 210 and the substrate 202. The spot size is mostly on the order of 100 μm.

By changing the distance of the flat-field lens 210 from the substrate 202 to be lettered, or by adjusting the beam expansion 228 in front of the scan head 200, the spot size can be systematically changed to produce fine markings with high energy density or wider markings with lower energy density. For fine markings, especially the beam expansion 228 can be set such that the beam waist lies in the plane of the flat-field lens 210. In this case, if applicable, the beam diameter must be reduced through the mode diaphragm 224 to prevent the edge of the beam pattern from covering the edge of the entrance aperture. In this way, the total energy of the beam can be reduced. For their part, the energy density and total energy, in turn, influence the type and the appearance of the markings.

Either the scan head 200 can be affixed directly at the laser, or the laser light is guided to the scan head through an optical waveguide or through beam deflections. Beam deflections are currently preferred, since the power and beam quality losses here are very low.

The continuous output of the laser marker used typically lies between a few watts and a few hundred watts. Nd:YAG lasers can be operated with laser diodes for lower total output with smaller construction dimensions and high beam quality, or with pump lamps for high outputs. In order to not reduce the speeds of an industrial production line of value documents, the markings are advantageously executed with very fast-moving galvanometers that can guide the beam across the substrate at more than 1 m/s, preferably at more than 4 m/s. Speeds above 10 m/s are particularly preferred, and suitable especially for effects that do not require great total energy. At these speeds, only a small proportion of energy per section is deposited in the substrate or the coating, such that, advantageously, lamp-pumped Nd:YAG lasers with an output of about 100 watts are used.

Examples of typical inscription parameters and settings include: A mode diaphragm having an opening between 1 and 5 mm, preferably 2 mm; a beam expansion that lies between 3× and 9×, preferably 4.5×; a setting of the focus of the beam-expanding telescope that occurs such that a maximum power throughput is achieved at the entrance aperture of the scan head; a scan head that is designed for beam apertures between 7 and 15 mm, preferably about 10 mm; a flat-field lens that exhibits a focal length between 100 and 420 mm, preferably of about 163 mm; a working distance between the lens and the substrate that is chosen such that a certain defocussing occurs due to a smaller beam distance than corresponds to the focal length; and pulse frequencies that lie between 20 kHz and continuous-wave operation.

By varying the inscription parameters, such as the laser output, exposure time, spot size, inscription speed, working mode of the laser etc., the marking results can be varied within a broad scope. For example, line-shaped markings, such as an inscription, or also areal markings filled with a line pattern can be produced by the laser.

To produce a line-shaped marking, for example an inscription, the laser output is advantageously set to a value between 50 and 100 W, preferably to about 80 W, and the traverse speed of the laser beam to a value between 2 and 10 m/s, preferably to about 7 m/s.

In producing an areal marking, the laser power is advantageously between 50 and 100 W, preferably at about 95 W, and the traverse speed of the laser beam is set to a value between 5 and 30 m/s, preferably to about 20 m/s. The line distance of the individual lines forming the surface pattern is advantageously between 50 and 380 μm, particularly preferably between 180 and 250 μm.

In this way, through the laser, line-shaped markings can be produced, such as an inscription, or also areal markings filled with a line pattern, the line distance in the latter case expediently being between 50 and 380 μm, preferably between 180 and 250 μm. In addition to the shown impingement of the substrate 202 from the front, so from the printed side, a lasering from the back of the substrate may also be used. In this case, it is advantageous when the substrate 202 exhibits as low an absorption as possible at the laser wavelength.

The laser parameters can also be so changed during the lasering that different effects result. For example, the pulse sequence frequency in pulsed lasering can be so changed during the process that also the partially transmissive layer is removed in certain regions.

Banknotes or value carriers are usually printed on in sheet form, but it is also possible to print on webs. In general, when printing on sheets, it is possible to achieve smaller register variations that are on the order of +/−1.5 mm. The individual notes, in the following also called individual ups, are disposed in rows of ups next to and columns of ups one below the other.

Preferably, the devices for laser marking are attached such that they are allocated to a column of ups, as depicted in FIG. 12.

FIG. 12 shows a laser marker 230 in which, with a plurality of lasers, a sheet 232 is simultaneously provided with a laser marking and a laser modification region. In the example shown, the sheet 232 exhibits six columns and six rows such that 36 individual ups 234 of bank notes or other data carriers are disposed on this sheet. The sheet moves in the direction of the arrow. For each column is disposed above the printing sheet 232 a laser tube 236 that, together with the associated scan head 238, produces the laser markings or modifications in each of the individual ups 234 disposed in that column. Through this arrangement, the throughput can be greatly increased, since a single laser beam need not be moved across the entire printing sheet, but rather merely one movement is required in the boundaries of the columns of the printing sheet. The impingement on the individual ups occurs, as described for FIG. 11, via the deflection of the laser radiation by means of the mirrors contained in the scan heads 238.

The typical speed of a sheet-fed printing machine is 10,000 sheets/h. Depending on the embodiment, this corresponds to web speeds of 2 m/s to 3.3 m/s. These web speeds are also achieved when printing on web-shaped materials. Since the laser marking process is to be adapted in its speed to the typical conditions of a printing line, the markings must be able to occur on substrates that move at the cited speeds. Also the print image detection undertaken, if applicable, must take place at these speeds.

FIG. 13 shows a schematic view of a printing machine 250 that is provided with an inventive laser system 270 for marking banknotes and the like. The laser system 270 itself is depicted in greater detail in FIG. 14, in cross section.

The printing machine 250 exhibits a stream feeder 252, a printing tower 254 having a stop drum 256 to take up the sheet, an impression cylinder 258 and inking units 260, and a tray 262. The impression cylinder 258 has parts of the span that take up two sheets (black in FIG. 13) and interruptions (white in FIG. 13).

In the stream feeder 252 may be located paper sheets that have already been printed on, that only have yet to be lasered, and that now pass through the printing machine 250 merely to introduce the markings. However, through the inventive design of the laser system 270, it is now also possible to both print on and laser the paper sheets in the printing machine 250. The printing process carried out together with the lasering can especially be a numbering of a banknote sheet already printed on, or a general printing step, for example an intaglio printing imprint.

The inventors have now found that the location best accessible for the lasering is the impression cylinder 258. In the stream feeder 252, the sheets are stacked such that each sheet drawn in next is guided under the following one. In the tray 262, the sheets are "free fluttering," that is, guided fixed only at the gripper edge until they lie on the stack.

Moreover, from the cylinder-shaped elements, the impression cylinder 258 has the advantage that the span is dimensioned for two sheets and thus exhibits the lowest curvature. The smaller the curvature, the more minor are the distortions that must be compensated, and the smaller is the change in the beam diameter due to the changing distance of the flat-field lens 210 (FIG. 11) and the printing sheet.

A particular advantage of the structure of the laser system 270 consists in that the feeder 252 and the impression cylinder 258 with its paper guidance and the downstream inking units 260 remain accessible. In this way, with the printing machine 250, also conventional numberings can be executed, especially also simultaneously with the lasering. For this reason, an arrangement of the laser system 270 above the feeder 252 is less favorable. According to the present invention, the resonator 222 and the scan head 200 of each of the lasers are spatially separated, since the laser resonators 222 cannot be tilted, but rather, for a controlled flow of cooling water, must be built in horizontally.

In principle, mirrors or optical waveguides can be used to direct the laser beam from the resonator 222 to the scan head 200. However, optical waveguides have the disadvantage that the beam quality deteriorates and power losses occur. Furthermore, the parameter range is limited, since pulses that are too strong, as can occur in Q-switched pulsed lasers, can destroy the optical waveguide. Thus, as is best perceptible in FIG. 14, in the laser system 270 according to the present invention, mirrors 272 are used that are disposed at the corners of the beam pipes 274. In the cross section in FIG. 14, only one laser is depicted, but it is understood that, in practice, multiple, for example six, lasers are disposed in series, as shown in FIG. 12.

The stand of the laser system 270 consists of a reinforced frame 276 that was designed in accordance with a finite-elements-method analysis of the occurring vibrations. Here, the goal is that the lasers co-execute the vibrations of the printing machine 250, which are unavoidable with simultaneous printing, without being rocked. The frame 276 is attached above the housing of the inking units 260 such that the cooling water conduits of the laser point in the direction of the radial arm, and is affixed at the screw threads for cranes to transport the printing machine 250, which provide a large load absorption.

The frame 276 is formed having two parts, an inner frame being suspended in an outer frame. The outer frame can be quickly moved back and forth between multiple locking positions and a top position with the aid of gas pressure springs (not shown) attached from outside. For this, for example, an awning crank and a cable winch can be used. The locking positions are allocated to the different possible focal lengths of the flat-field lenses 210 and thus the different working distances.

The inner frame is finely adjustable in its height and in its angle, for example with the aid of cranks, to facilitate a precise alignment of the height of the flat-field lens 210 and the direction of the radiation 206. The height position can be indicated by scales and is thus precisely reproducible. Due to the locking positions, this alignment is not lost if, for example for work on the inking units 260, the lasers are to be moved up and back down.

The resonators 222 are disposed on plates 278 that can be moved together with the beam pipes 274 to align the inscription units with the columns of ups. Above the impression cylinder 258 is disposed a shielded chamber 280 that shields laser radiation and that serves to exhaust the created gases and dusts via piping not depicted in the drawing. Here, the shielded chamber 280 is bedded such that its position is not changed in the different locking positions for the standard working distances; only at the position for working on the inking unit 260 is it also moved upward. The shielded chamber 280 closes toward the impression cylinder 258 with brushes that are nontransparent to the laser light, and toward the scan heads 200 with the aid of bellows 282.

The control of the lasering occurs through a sensor for detecting the sheet or the printing, and through the measurement of the speed. The sheet edge sensor is a highly precise and fast diffuse reflection sensor.

The speed of the impression cylinder 258 is picked off by a magnetic probe via periodically magnetized bands that were placed under the linings of the impression cylinder. The impression cylinder does exhibit parts of the span on which no sheet comes to rest. In scanning, a resolution of 25 μm is achieved. The assumption of a constant speed is not possible, since the different simultaneous processes of the printing machine 250 are typically driven via a central motor, and the sheet motion is thus subject to periodic variations.

The signal of the diffuse reflection sensor is conveyed to a "trigger box" that takes over the control of the laser. It can be programmed such that, for the laserings, the starting distance, measured via the magnetic tapes, and the distances of the subsequent markings can each be entered independently of each other via a computer program.

A block for further signals of the diffuse reflection sensor can be defined either as a blocking distance or by a determination of the sheet position by the magnetic tapes. Here, a start signal is permitted only after one end of the magnetic tape (and thus the sheet end), and after one start signal, is blocked until an end of the magnetic tape is reached again.

The invention claimed is:

1. A method for manufacturing a data carrier having a visually perceptible marking in the form of patterns, letters, numbers or images, the method comprising steps of a) choosing a predefined laser radiation spectrum, b) applying a radiation absorbing layer to a substrate, the radiation absorbing layer comprising a metallic effect ink, c) imprinting the radiation absorbing layer with a partially transmissive layer, thereby providing the substrate with a coating comprising the radiation absorbing layer and the partially transmissive layer, the imprinting comprising applying the partially transmissive layer by means of intaglio printing wherein an embossing is produced in the coating in the partially transmissive layer, the imprinting further causing pressing of the substrate with the pressure of an intaglio printing technique and thereby creating a bond of the partially transmissive layer with the substrate via a region of the radiation absorbing layer; and d) impinging the coating with laser radiation of the predefined laser radiation spectrum to produce the visually perceptible marking in at least the radiation absorbing layer;

wherein the partially transmissive layer is at least partially transmissive to laser radiation, and the bond created by the pressing of the coating allows the visually perceptive marking to be produced in the radiation absorbing layer without destroying the partially transmissive layer.

2. The method according to claim 1, characterized in that the imprinting with the partially transmissive layer in step c) is in the form of fine patterns.

3. The method according to claim 2, wherein the imprinting is in the form of guilloches, microtext, graphic elements or the like.

4. The method according to claim 1, characterized in that the radiation absorbing layer in step b) is imprinted by means of screen printing.

5. The method according to claim 1, characterized in that, in step b), a coated or uncoated foil comprises the radiation absorbing layer.

6. The method according to claim 1, characterized in that the radiation absorbing layer in step b) comprises a contiguous area.

7. The method according to claim 1, characterized in that the applying of the radiation absorbing layer is in sub-regions with different printing methods or printing parameters, such that the sub-regions are affected differently upon the impinging step.

8. The method according to claim 1, further comprising the step of choosing laser parameters such that the partially transmissive layer is completely maintained upon the impinging step.

9. The method according to claim 1, further comprising the step of changing laser parameters during the impinging step to partially maintain and partially remove the partially transmissive layer.

10. The method according to claim 1, further comprising the steps of generating one or more further embossings in the coating;

and choosing laser parameters such that the embossing in the coating and/or the one or more further embossings are maintained.

11. The method according to claim 1, further comprising the steps of generating one or more further embossings in the coating;

and changing laser parameters during the impinging step to partially maintain and partially remove the embossing in the coating and/or the one or more further embossings.

12. The method according to claim 1, characterized in that the impinging occurs from the substrate front, on which the radiation absorbing and partially transmissive layers are applied.

13. The method according to claim 1, characterized in that the impinging occurs from the substrate back.

14. The method according to claim 1, characterized in that the radiation absorbing layer and the partially transmissive layer are applied completely or partially overlapping each other.

15. The method according to claim 1, further comprising the step of applying a protective layer before and/or after the impinging step.

16. The method according to claim 1 characterized in that the impinging step further comprises using an infrared laser in the wavelength range between 0.8 μm and 3 μm as a laser source.

17. The method according to claim 16 wherein the laser source comprises a Nd:YAG laser.

18. The method according to claim 1, characterized in that, the impinging step further comprises guiding the laser beam across the substrate with a speed of more than 1 m/s.

19. The method according to claim 18, wherein the speed is more than 4 m/s.

20. The method according to claim 18, wherein the speed is more than 10 m/s.

* * * * *